US007854200B2

(12) United States Patent
Livingston

(10) Patent No.: US 7,854,200 B2
(45) Date of Patent: Dec. 21, 2010

(54) HOLD DOWN DEVICE FOR MATERIAL PLACED ON PLATEN OF DIGITAL PRINTING MACHINE

(76) Inventor: John C. Livingston, 9794 Black Rd., Centerville, IN (US) 47330

( * ) Notice: Subject to any disclaimer, the term of this patent is extended or adjusted under 35 U.S.C. 154(b) by 606 days.

(21) Appl. No.: 11/983,025

(22) Filed: Nov. 6, 2007

(65) Prior Publication Data

US 2008/0163775 A1 Jul. 10, 2008

Related U.S. Application Data

(60) Provisional application No. 60/879,144, filed on Jan. 6, 2007.

(51) Int. Cl.
*B41F 1/28* (2006.01)

(52) U.S. Cl. ..... 101/474; 101/126

(58) Field of Classification Search ..... 101/126, 101/474

See application file for complete search history.

(56) References Cited

U.S. PATENT DOCUMENTS

| | | | | |
|---|---|---|---|---|
| 2,643,399 | A * | 6/1953 | Haefliger | 5/692 |
| 2,699,581 | A * | 1/1955 | Schlegel | 49/490.1 |
| 4,483,323 | A * | 11/1984 | Murphy | 126/684 |
| 4,959,081 | A * | 9/1990 | Mathellier | 49/490.1 |
| 4,998,471 | A * | 3/1991 | Harrington | 101/126 |
| 5,355,792 | A * | 10/1994 | MacNaughton et al. | 101/127.1 |
| 6,675,510 | B2 * | 1/2004 | Ocampo | 38/102.91 |

* cited by examiner

*Primary Examiner*—Ren Yan
(74) *Attorney, Agent, or Firm*—Led J. Aubel

(57) ABSTRACT

A device is provided for holding down textile material (on which images or text are to be printed) on the platen of a digital printing machine. The device includes facing flexible rubber pads or seals mounted on the periphery of the platen. The seals have opposed gripping surfaces which touch or have a selected limited spacing there between. The textile material is pushed and tucked in between the seals. The seals grip and hold the material in position, to provide a smooth material surface on which the ink is applied. After the printing operation, the textile material is pulled out from the seal grip.

8 Claims, 3 Drawing Sheets

Fig 3
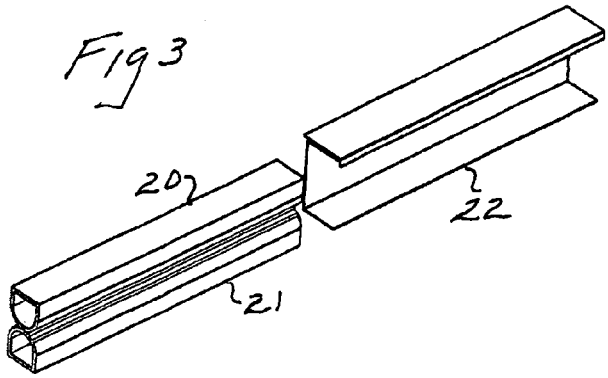
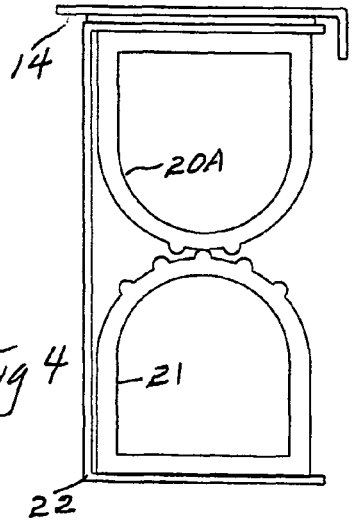
Fig 4
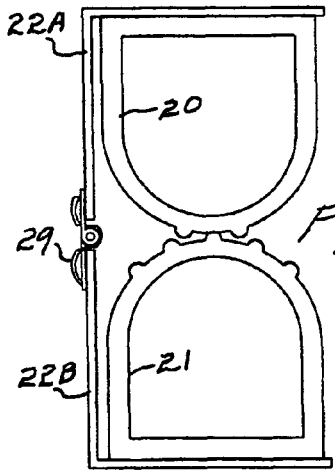
Fig 8

HOLD DOWN DEVICE FOR MATERIAL PLACED ON PLATEN OF DIGITAL PRINTING MACHINE

This patent application is based on, and claims the priority date of, U.S. provisional patent application Ser. No. 60/879,144 filed on Jan. 6, 2007, having the same title as this application and filed by John C. Livingston, the same inventor named herein.

BACKGROUND OF INVENTION

The present invention relates to the relatively recent development and commercial exploitation of digital printing techniques in which a full size printer prints on textiles directly. For several reasons, the aforesaid method is an improvement over the long used and standard screen printing methods. The digital printing method makes possible the reproduction of complicated design, to print colors that were not feasible before, to readily make changes in design etc. More recently, improvements on digital printers have enabled printers to print on different type materials and on material of different sizes and on material mounted on relatively large platen bases. One of the problems in placing the materials on the platen is that the material must be wrinkle free, and be stretched tautly and smoothly over the platen. Since the platens and the material mounted thereon were both relatively of big size, better means have been sought for mounting the material on the platen in a smooth, wrinkle free and firmly taut fashion.

SUMMARY OF INVENTION

The present invention relates to a digital printer for textile material wherein an improved device is provided for holding down the textile material on the platen of a printing machine. The textile is held down in a smooth, firm and wrinkle free position for purposes of suitably printing images and/or text thereon. The inventive device includes spaced facing extruded rubber seals comprising gripping seals mounted on the sides of the platen. The seals have opposed gripping surfaces with a limited spacing there between. The material is pushed and tucked into the limited space. The seals grip and hold the material, in position throughout the periphery of the platen, to provide a smooth material surface on which the ink is applied. After the printing operation is completed, the material is pulled out from the grip of the seals.

The foregoing features and advantages of the present invention will be apparent from the following more particular description of the invention. The accompanying drawings, listed herein below, are useful in explaining the invention.

DRAWINGS

FIG. 2 is an exploded view of two rubber gripping seals indicating the mounting of the seals within a rigid C-shaped elongated flange;

FIG. 4 is a cross section view of the seals showing the gripping surfaces of the seals;

Figure 5A:
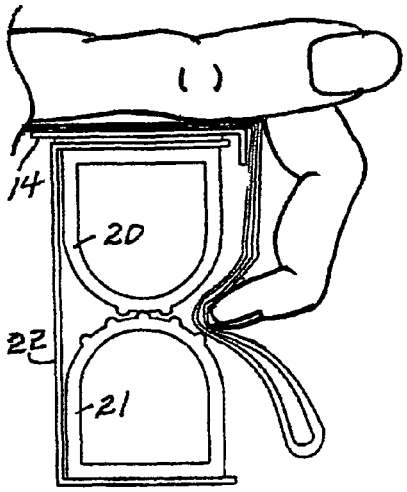
FIG. 5A depicts the textile material being forced into the limited space between the gripping seals by the operator's finger.
Figure 5B:
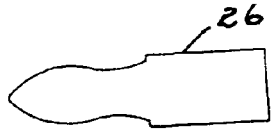
Figure 6:
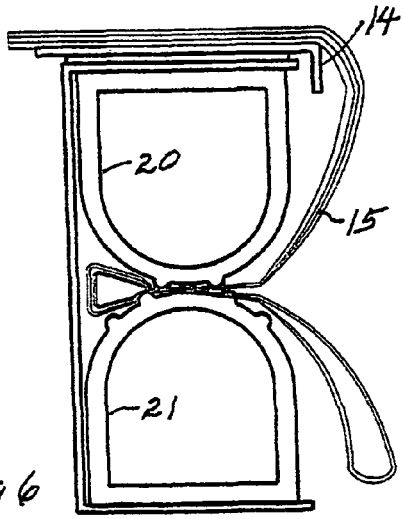
Figure 7:
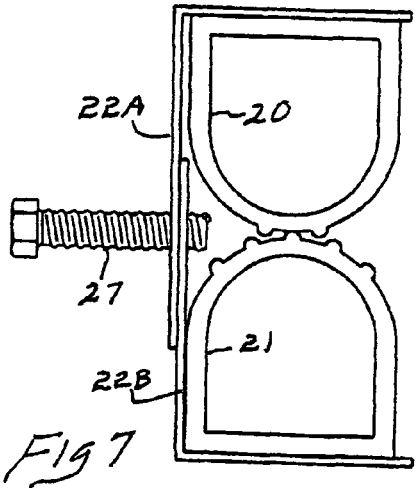

FIG. 5B indicates a rod or blade or roller that can alternatively and conveniently be used to force the textile into the space between the seals;

FIG. 6 shows the textile material in a gripped position between the reformed or compressed seals to provide the gripping action;

FIG. 7 shows a flange with adjustable sides for adjusting the spacing of the seals for compensating for textiles of different texture and/or thickness; and FIG. 8 shows spring clamps that are useful in adjusting the positioning and tension of the gripping seals to accommodate seals of differing materials.

DESCRIPTION OF THE INVENTION

Figure 1:
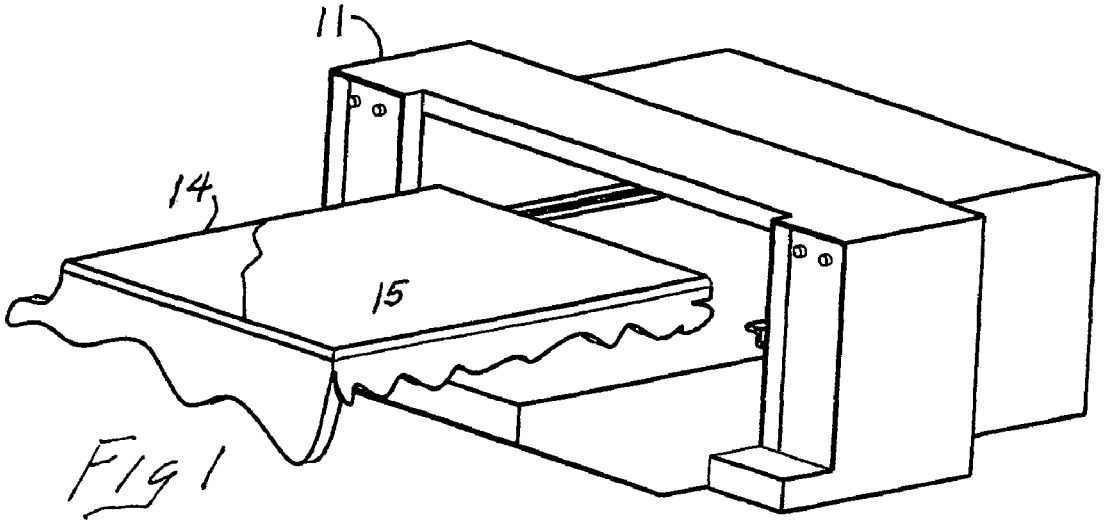
FIG. 1 depicts a textile digital printing machine of the type on which the Hold Down Device of the invention is mounted and further depicts a T-Shirt mounted on the movable platen preparatory to insertion into the printing unit of the machine.

FIG. 1 shows a digital textile printing machine 11, of suitable known type, wherein a textile material to be printed on, herein indicated as a T-shirt 15, is placed on (draped over) a platen 14. Platen 14 is commonly rectangular in shape. In preparation for the printing procedure, the T-shirt 15 is removably held on the platen 14. The platen 14 can then be moved (slid) into the printing portion of the machine 11 for positioning the textile material under the print head, as is well known. Importantly, it is necessary that the material on which an image or text is to be printed be smooth and wrinkle free to obtain a clear and blur free text and/or images.

Figure 2:
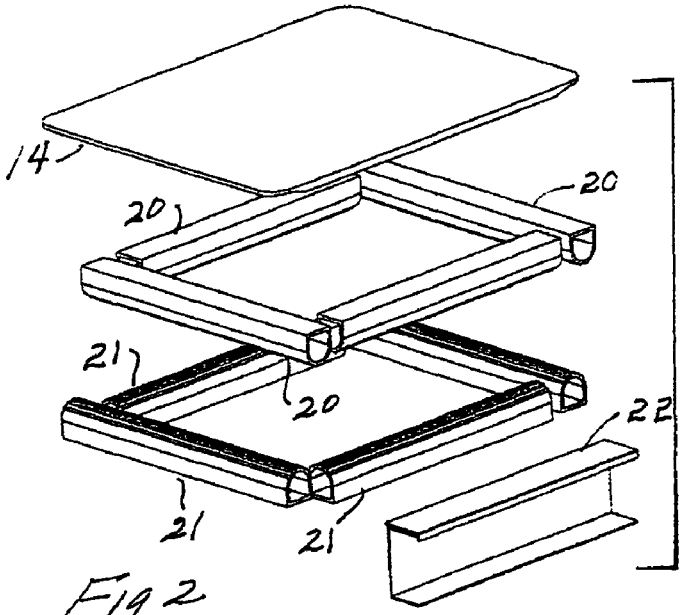
FIG. 2 is an exploded view of the gripping device of the invention showing the gripping seals mounted on the periphery of the platen.

Refer now also to FIGS. 2 and 3. For the purpose of mounting the textile material on the platen 14 as required, gripping pads or seals 20 and 21, made of flexible material such as rubber formed in tubular cross section, are positioned on the periphery of the platen 14, as indicated in FIG. 2. FIG. 3 shows that the gripping pads or seals generally labeled 20 and 21 respectively comprise four sections for the four sides of the rectangular platen 14 and are mounted on respective C-shaped flanges or channels generally labeled 22. Flanges 22 are, in turn, suitably mounted on the periphery of the platen 14, as indicated in FIGS. 2 and 4. The C-shaped flanges 22 are positioned to have to the opening of the C-shape facing outwardly relative to the platen 14.

The first seal, generally labeled 20, and the second seal, generally labeled 21, are positioned in a facing or fronting elongated relation adjacent each other, and in the respective flanges 22 as indicated in FIGS. 2-4. Either one or both seals may have ribs, teeth or protrusions 23 on the periphery thereof to assist in holding the textile material. See for example, seals 20A and 21 in FIG. 4 and seals 20 and 21 in FIG. 5A. In one embodiment the seals are mounted to have a spacing of one thirty second of an inch (1/32) between their facing surfaces. The spacing is dependent on the type and thickness of the material being printed upon. For very thin or slippery material such as rayon or silk the seals may be mounted in a position touching one another.

As mentioned above with reference to FIG. 2, there are four sections of gripping seals or pads 20 and 21, and each section of seals 20 and 21 mounted in a respective flange 22. One section of seals and the associated flange is mounted on each side of the platen 14s, one section of seals and the associated flanges are mounted the front, and other section of seals is mounted on the rear end of the platen. For purposes of clarity in the drawing of FIG. 2, only the flange 22 on one side of the platen is depicted; the other flanges are omitted to permit an unobstructed view of the positioning of the four sections of the gripping seals 20 and 21. Note that each section of seals includes the two facing seals 20 and 21.

In one embodiment, the seals are of foam rubber having a thirty durometer hardness. Dependent on the textile being printed, various types of flexible material may be used for the seals. In a preferred embodiment, both seals are of foam rubber, however in other embodiments one seal may be of a compressible (yielding) material and the other seal could be of a relatively non-compressing material, such as rigid plastic.

Refer now also to FIG. 5A which depicts a preferred method of inserting a textile 15 to be gripped by the seals 20 and 21 which form a snug but flexible gripping device. As mentioned above, in one embodiment the seals 20 comprises elongated tubular members having a smooth surface that contacts the textile, and seals 21 comprises elongated tubular members having ribs that contact the textile. The seals may also comprise essentially identical units both having ribs on their textile engaging surface, as depicted by seals 20A and 21 in FIG. 4.

Seals 20 and 21 comprise elongated tubular bodies of a foam rubber material that is compressible and the seals are positioned in flanges 22 fronting or facing each other. The seals may be in touching relation to each other, or mounted to have a limited spacing there between. The spacing between the seals is determined to accommodate the particular thickness of material which is to be printed. The textile 15 is placed over the platen 14 in a position to extend and drape over the seals 20 and 21. Using finger pressure the textile 15 is tucked (pushed) into the limited space between the seals 20 and 21.

As shown in FIG. 6, the seals 20 and 21 are compressed to engage and hold the textile 15 in position. This tucking or pushing in of the textile material is done around the periphery of the platen 14, as needed. Dependent on the material, the front and back ends of the material may not have to be tucked in. The platen 14 and textile 15 are then moved into printing position in machine 11. After the digital printing is done, the platen 14 is withdrawn from the machine 11 and the textile 15 is pulled out of engagement between the seals 20 and 21.

FIG. 5B shows a rod or blade 26 that may be conveniently used, instead of the operator's finger, to tuck in the textile material 15 between the seals.

FIG. 7 depicts that in another embodiment showing that the C-shaped flange 22 may be made in essentially two elongated L-shaped halves 22A and 22B that may be attached to each other by suitable bolts or screws 27 for adjusting the size of the cross section of the flange 22 to accommodate seals 20 and 21 of varying diameters, and/or to adjust the gripping force of the seals 20 and 21 mounted in the flange.

FIG. 8 shows that the flange halves 22A and 22B can be spring loaded as at 29 to further provide additional horizontal adjustment of the positioning of the seals 20 and 21 mounted in the flanges 22A and 22B.

While the invention has been particularly shown and described with reference to preferred embodiments thereof, it will be understood by those skilled in the art that various changes in form and details may be made therein without departing from the spirit and scope of the invention.

The invention claimed is:

1. A device for holding down textile material on a platen of a digital printing machine comprising, a. elongated compressible pads or seals;

b. elongated open flanges;

c. said flanges being mounted adjacent the periphery of said platen with the open side of the flanges facing outwardly relative to said platen and said seals being mounted in said flanges in a fronting relation to each other;

d. said seals forming a limited spacing there between;

e. said limited spacing permitting the textile material to be pushed into the spacing formed when said seals are compressed to enable said seals to grip and hold said material in a relatively firm position on said platen; and, f. said compressible pads or seals allowing said textile material to be pulled out from said spacing as required.

2. A device as in claim 1 wherein said flanges are C-shaped and are mounted with the open side of the C-shape facing outwardly relative to said platen, and said pads or seals are tubular in cross section and are mounted in said flanges in fronting adjustable relation to each other.

3. A device for holding down textile material on a platen of a digital printing machine comprising, a. elongated compressible seals;

b. C-shaped flanges;

c. said flanges being mounted on the periphery of said platen with the open side of the C-shape facing outwardly relative to said platen, d. said seals being mounted in said flanges in a facing relation to each other;

e. said seals forming a textile gripping surface with a limited spacing there between;

f. said open side of said C-shape flange permitting the textile material to be forced into said gripping surface to removably hold said textile material in position on said platen; and, g. said compressible seals allowing said textile material to be pulled out of said gripping surface as required.

4. A device as in claim 3 wherein said seals are positioned in touching relation to one another, and are adjustable to provide a selected spacing there between, dependent on the material being held down.

5. A device as in claim 3, wherein said C-shaped flanges comprise two halves or L-shaped flanges affixed in inverted relation to one another.

6. A device as in claim 3 wherein said C-shaped flanges comprises two halves or L-halves flange that are spring loaded relative to one another.

7. A device as in claim 3 wherein said seals include protrusions to grip the textile material.

8. A device as in claim 3 wherein one of the seals is smooth and said other seal includes protrusions thereon for contacting said textile material.

* * * * *